US009597814B2

(12) United States Patent
Shiokawa

(10) Patent No.: US 9,597,814 B2
(45) Date of Patent: Mar. 21, 2017

(54) PAPER PROCESSING APPARATUS AND IMAGE FORMING SYSTEM

(71) Applicant: Konica Minolta, Inc., Tokyo (JP)

(72) Inventor: Tsuyoshi Shiokawa, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 87 days.

(21) Appl. No.: 14/739,018

(22) Filed: Jun. 15, 2015

(65) Prior Publication Data

US 2015/0360898 A1 Dec. 17, 2015

(30) Foreign Application Priority Data

Jun. 17, 2014 (JP) ..... 2014-124346

(51) Int. Cl.

| | |
|---|---|
| ***B26D 7/18*** | (2006.01) |
| ***B65H 35/04*** | (2006.01) |
| ***B65H 37/04*** | (2006.01) |
| ***B65H 37/06*** | (2006.01) |
| ***B26D 1/08*** | (2006.01) |
| ***B26D 7/02*** | (2006.01) |
| ***B65H 5/04*** | (2006.01) |

(Continued)

(52) U.S. Cl.

CPC ..... *B26D 7/18* (2013.01); *B26D 1/085* (2013.01); *B26D 7/02* (2013.01); *B42C 1/12* (2013.01); *B42C 19/04* (2013.01); *B65H 5/04* (2013.01); *B65H 5/10* (2013.01); *B65H 7/20* (2013.01); *B65H 35/04* (2013.01); *B65H 35/06* (2013.01); *B65H 37/04* (2013.01); *B65H 37/06* (2013.01); *B65H 45/28* (2013.01); *G03G 15/6544* (2013.01); *B26D 2007/1809* (2013.01); *B65H 2301/515* (2013.01); *B65H 2301/543* (2013.01); *B65H 2801/27* (2013.01); *B65H 2801/48* (2013.01); *G03G 2215/00814* (2013.01); *G03G 2215/00831* (2013.01); *G03G 2215/00936* (2013.01); *Y10T 83/2092* (2015.04)

(58) Field of Classification Search

CPC ... B65H 5/04; B65H 5/10; B65H 5/14; B65H 2301/4224; B65H 2301/515; B65H 7/20; B26D 1/085; B26D 7/02; B26D 7/18; B26D 2007/1809

USPC ..... 270/32, 37, 52.18

See application file for complete search history.

(56) References Cited

U.S. PATENT DOCUMENTS 7,854,581 B2 * 12/2010 Kubo ..... B42C 19/02 270/58.07

7,987,751 B2 * 8/2011 Shiokawa ..... G03G 15/6523 222/527

FOREIGN PATENT DOCUMENTS

JP 2005-169598 A * 6/2005

JP 2007061967 A 3/2007

(Continued)

*Primary Examiner* — Leslie A Nicholson, III

(74) *Attorney, Agent, or Firm* — Lucas & Mercanti, LLP

(57) ABSTRACT

A control unit of a paper processing apparatus controls a driving unit such that pressing by a pressing member is released after an end portion of a paper bundle pressed by the pressing member is cut by a cutting blade, and controls, when determining that a front end portion of a removal member does not reach the pressing member at a position of the pressing member in a state in which the pressing by the pressing member has been released, the driving unit to move the pressing member to a position at which the front end portion of the removal member reaches the pressing member after the paper bundle is taken out.

10 Claims, 17 Drawing Sheets

(51) Int. Cl.

| | |
|---|---|
| ***B65H 5/10*** | (2006.01) |
| ***B65H 7/20*** | (2006.01) |
| ***B42C 19/04*** | (2006.01) |
| ***G03G 15/00*** | (2006.01) |
| ***B42C 1/12*** | (2006.01) |
| ***B65H 35/06*** | (2006.01) |
| ***B65H 45/28*** | (2006.01) |

(56) References Cited

FOREIGN PATENT DOCUMENTS

| | | | | |
|---|---|---|---|---|
| JP | 2007-260805 | A | * | 10/2007 |
| JP | 2007-326200 | A | * | 12/2007 |
| JP | 2009-279692 | A | * | 12/2009 |

* cited by examiner

PAPER PROCESSING APPARATUS AND IMAGE FORMING SYSTEM

CROSS-REFERENCE TO RELATED APPLICATION

This application is based on Japanese Patent Application No. 2014-124346 filed on Jun. 17, 2014, the contents of which are incorporated herein by reference.

BACKGROUND

1. Technical Field

The present invention relates to a paper processing apparatus and an image forming system.

2. Description of Related Arts

An image forming system having an image forming apparatus such as a copy machine and a printer has a paper processing apparatus for cutting a paper bundle as a post-processing apparatus.

As a paper processing apparatus for cutting a paper bundle, there has been known a paper processing apparatus having a pressing member for pressing the paper bundle, a cutting blade for cutting an end portion of the paper bundle pressed by the pressing member, and a removal member for removing cutting waste of the paper bundle. For example, a sheet cutting apparatus disclosed in Japanese unexamined Patent application publication No. 2007-61967 is configured to have a rotating brush 185, and to make the rotating brush 185 which is rotated, contact with a blade receiving surface 150a, so that cutting waste cut by a cutting blade 120a and attached to the blade receiving surface 150a is removed and falls down (paragraph 0047, FIG. 10 (a)).

In such a paper processing apparatus, it is typical that the removal member is designed to reach a position at which the cutting waste of the paper bundle is attached on the pressing member.

However, as described below, there is a case in which an interval between the removal member and the pressing member is widened, the removal member does not reach the pressing member and is not able to sufficiently remove the cutting waste attached to the pressing member. For example, when the pressing member presses the paper bundle or releases the pressing, there is a case in which the pressing member is configured to move in response to the thickness of the paper bundle. At this time, there may occur a case in which the removal member does not reach the pressing member as described above.

In addition, even though the pressing member is positioned spaced apart from the removal member, it is also considered that the removal member is designed to reach the pressing member to solve the aforementioned problem. However, due to a factor such as obstruction (interference) of other parts disposed in the vicinity of the removal member or the pressing member, there is a case in which it is difficult to design the removal member to reach the pressing member.

SUMMARY

The present invention is made in order to solve the abovementioned problems associated with the related art, and aims to provide a paper processing apparatus and an image forming system which can securely remove cutting waste of a paper bundle.

To achieve at least one of the abovementioned objects, a paper processing apparatus reflecting one aspect of the present invention comprises: a supporting member for supporting a paper; a pressing member which forms a space between the pressing member and the supporting member, and approaches and presses a paper bundle inserted into the space; a cutting blade which cuts an end portion of the paper bundle pressed by the pressing member; a removal member having a front end portion which removes cutting waste of the paper bundle; a driving unit which drives the pressing member; and a control unit which controls at least the driving unit, wherein the control unit controls the driving unit such that pressing by the pressing member is released after the end portion of the paper bundle pressed by the pressing member is cut by the cutting blade, and the control unit controls, when determining that the front end portion of the removal member does not reach the pressing member at a position of the pressing member in a state in which the pressing by the pressing member has been released, the driving unit to move the pressing member to a position at which the front end portion of the removal member reaches the pressing member after the paper bundle is taken out.

It is preferable that the control unit determines whether the front end portion of the removal member reaches the pressing member at the position of the pressing member in the state in which the pressing by the pressing member has been released, based on a thickness of the paper bundle or a number of papers constituting the paper bundle.

It is preferable that the removal member is composed of a paddle which is rotated.

It is preferable that the control unit controls the removal member such that the cutting waste of the paper bundle is repeatedly removed.

It is preferable that the control unit controls the driving unit such that the pressing member waits at the position, at which the front end portion of the removal member reaches the pressing member, when the paper bundle is inserted into the space.

It is preferable that the control unit controls the removal member to start an operation of removing the cutting waste of the paper bundle before the paper bundle is inserted into the space.

It is preferable that the paper bundle is saddle-stitched, and the end portion of the paper bundle, which is cut by the cutting blade, is an edge of the paper bundle.

The objects, features, and characteristics of this invention other than those set forth above will become apparent from the description given herein below with reference to preferred embodiments illustrated in the accompanying drawings.

DETAILED DESCRIPTION

Hereinafter, an embodiment of the present invention will be described below with reference to the drawings. In addition, the dimension ratio of each drawing is exaggerated for the sake of description, and may differ from an actual ratio.

Figure 1:
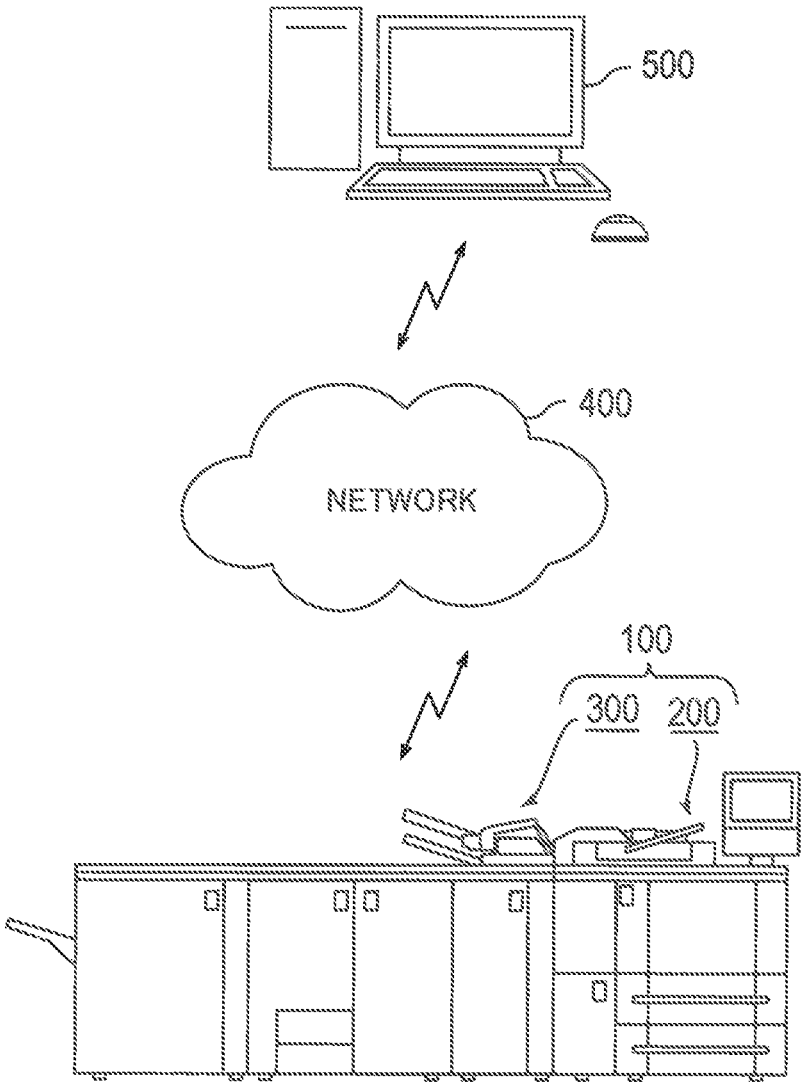
FIG. 1 is a schematic view of assistance in explaining an image forming system according to an embodiment of the present invention.

FIG. 1 is a schematic view of assistance in explaining an image forming system according to an embodiment of the present invention.

An image forming system 100 according to the present embodiment includes an image forming apparatus 200 and a paper post-processing apparatus 300, and is configured to be able to communicate with a computer device 500 via a network 400.

The computer device 500 is a terminal used for creating a print job including print data, and transmit the print job to the image forming system 100. The print data, for example, is data described in a PDL (Page Description Language) language form such as PostScript (registered trademark) and PCL (Printer Control Language), and includes print setting information and image information. The print setting information, for example, includes print setting of a finish size, etc., and the content of post-processing setting.

The image forming apparatus 200 constitutes a main unit of the image forming system 100, and is used for generating image data from the print data included in the received print job, and form (print) an image on a paper.

The paper post-processing apparatus 300 is a paper processing apparatus used for performing post-processing on a paper bundle including a plurality of stacked papers. The post-processing, for example, is saddle stitch bookbinding processing and edge cutting processing.

The network 400 includes various networks such as a LAN (Local Area Network) that connects computers or network devices to one another by a standard like Ethernet (registered trademark), Token Ring, FDDI (Fiber-Distributed Data Interface), etc., a WAN (Wide Area Network) that connects LANs to one another by dedicated lines, the Internet, and a combination thereof. A network protocol, for example, is TCP/IP (Transmission Control Protocol/Internet Protocol).

Next, the image forming apparatus 200 will be described in detail.

Figure 2:
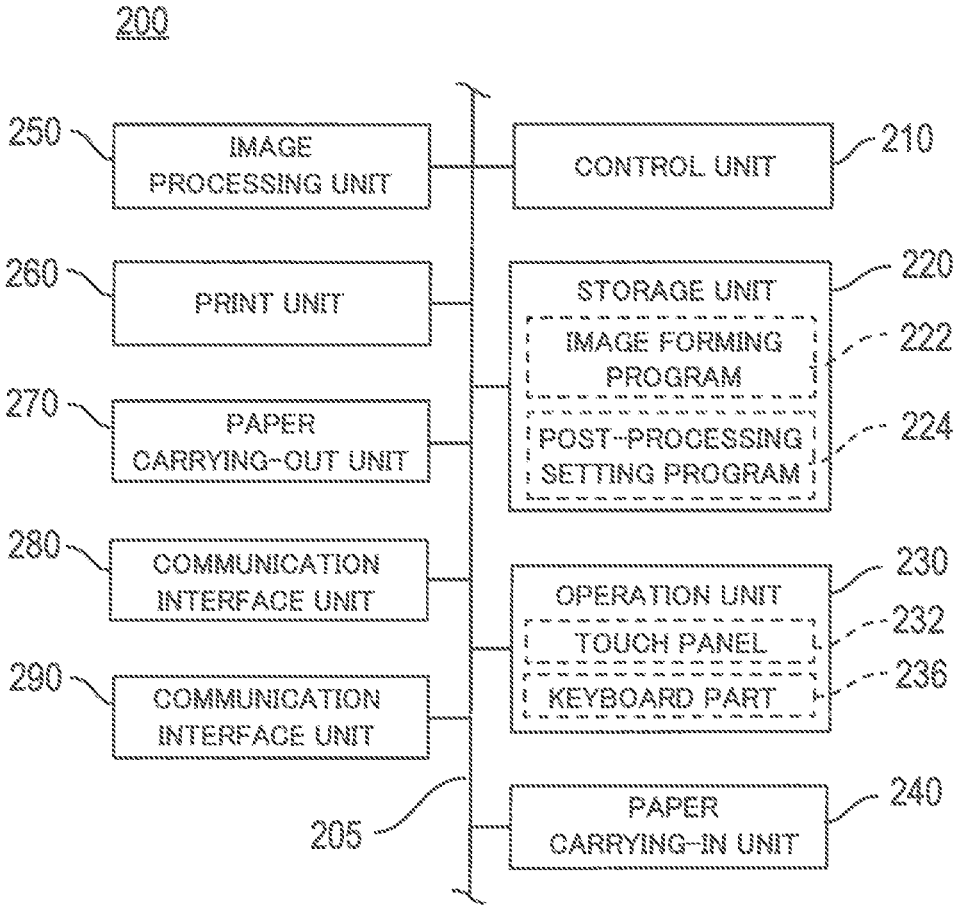
FIG. 2 is a block diagram of assistance in explaining an image forming apparatus shown in FIG. 1.

FIG. 2 is a block diagram of assistance in explaining the image forming apparatus shown in FIG. 1.

As shown in FIG. 2, the image forming apparatus 200 has a control unit 210, a storage unit 220, an operation unit 230, a paper carrying-in unit 240, an image processing unit 250, a print unit 260, a paper carrying-out unit 270, and communication interface units 280 and 290, and these are communicably connected to one another by a bus 205.

The control unit 210 is a control circuit including a microprocessor, etc., which perform control of each element and various types of operation processing according to programs, and each function of the image forming apparatus 200 is exhibited when the control unit 210 executes programs corresponding to each function.

The storage unit 220 is used for storing various programs and various pieces of data, and is configured by an appropriate combination of ROM (Read Only Memory), RAM (Random Access Memory), a rewritable nonvolatile memory (e.g. a flash memory), a hard disk drive device, etc. For example, a program stored in the ROM is read by the control unit 210 according to necessity, and is executed using the RAM as a work area for temporarily storing the program and data required for executing the program.

The stored program, for example, is OS (Operating System), an image forming program 222, and a post-processing setting program 224.

The image forming program 222 is used for controlling the image processing unit 250 to form (print) an image on a paper supplied from the paper carrying-in unit 240. The post-processing setting program 224 is used for transmitting setting (post-processing setting) data or control data of the paper post-processing apparatus 300 in the case of performing post-processing on a plurality of papers on which an image has been formed, to the paper post-processing apparatus 300. The post-processing setting data includes settings such as the size of a paper on which an image has been formed, a finish size, the number of staple needles, a stapling position of the staple needle, an edge cutting position, for example.

The operation unit 230 serves as a display unit and an input unit, and has a touch panel 232 and a keyboard part 236.

The touch panel 232 has a display part and a sensor for touch operation detection, and is configured to display a device configuration, a progress status of a print job, an occurrence status of an error, currently changeable setting, an alarm for calling a user's intention, etc., and to input an instruction through the position of a finger or a pen touched to the display part. The touch panel type is not particularly limited, and an electrostatic capacity type or a resistance film type can be employed. The keyboard part 236 has a plurality of keys including a selection key for designating a paper size, a numeric keypad for setting the number of copies, etc., a start key for instructing the start of an operation, a stop key for instructing the stop of an operation, a keyboard for inputting characters, etc.

The paper carrying-in unit 240 has a plurality of paper feeding trays, holds various papers inserted in advance by hands of a user, and is used for taking out papers instructed by the control unit 210 from the paper feeding trays, and to convey the papers toward the image processing unit 250.

The image processing unit 250 is used for performing RIP (Raster Image Processing) on print data, and to generate raster image data to be used in the print unit 260.

The print unit 260 is an image forming unit that forms a toner image on a paper serving as a recording medium by using an electrophotographic process including charging, exposure, developing, transfer, and fixing processes, and forms an image on the paper conveyed from the paper carrying-in unit 240 by using the data (the raster image data) from the image processing unit 250. The image processing method is not limited to the electrophotographic method, and an impact method, a thermal transfer method, an inkjet method, etc., can also be employed.

The paper carrying-out unit 270 is used for carrying out the paper, on which the image has been formed, toward the paper post-processing apparatus 300.

The communication interface unit 280 is a communication unit including an expansion device (a LAN board) for adding a communication function via the network 400 to the image forming system 100, and is used for transmitting/receiving data to/from the computer device 500 belonging to the network 400.

The communication interface unit 290 is used for transmitting/receiving data to/from the paper post-processing apparatus 300. The data is control data or post-processing setting data required in order to perform a post-processing job (a bookbinding job and a cutting job) in the paper post-processing apparatus 300.

Next, the paper post-processing apparatus 300 will be described in detail.

Figure 3:
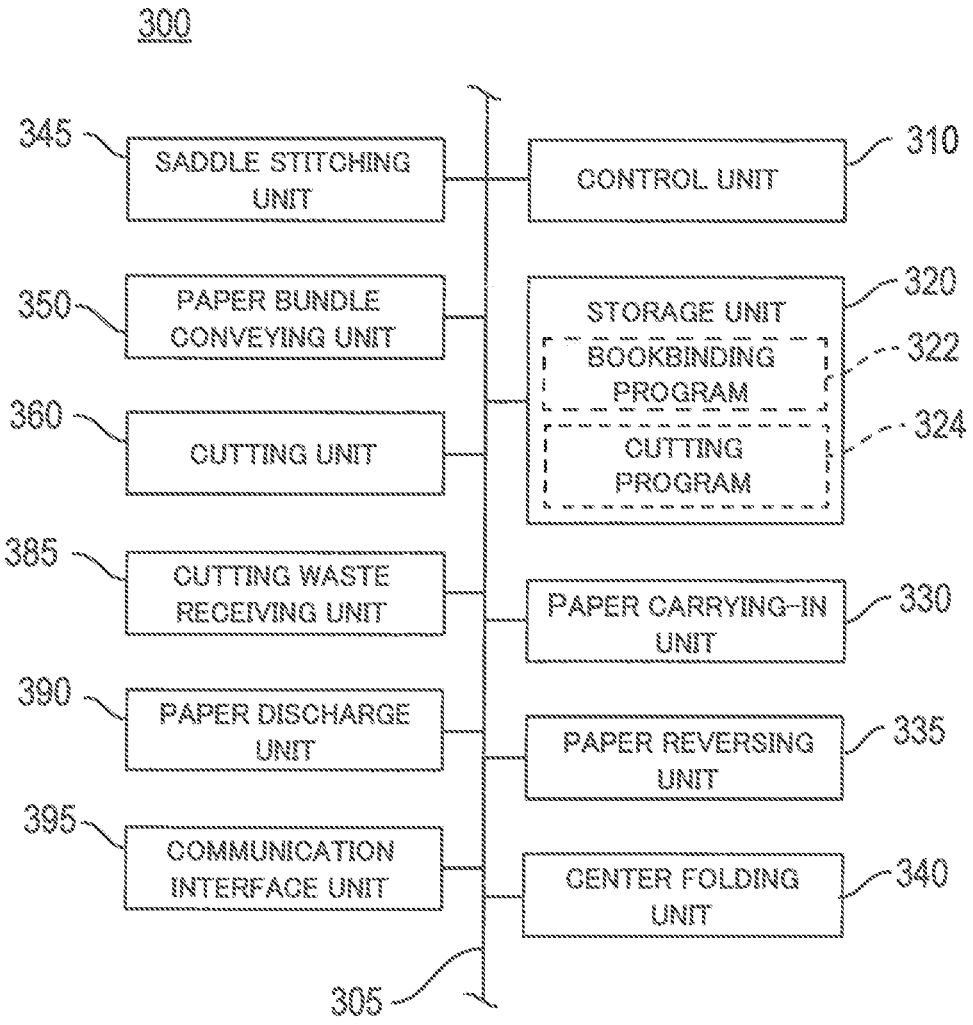
FIG. 3 is a block diagram of assistance in explaining a paper post-processing apparatus shown in FIG. 1.
Figure 4:
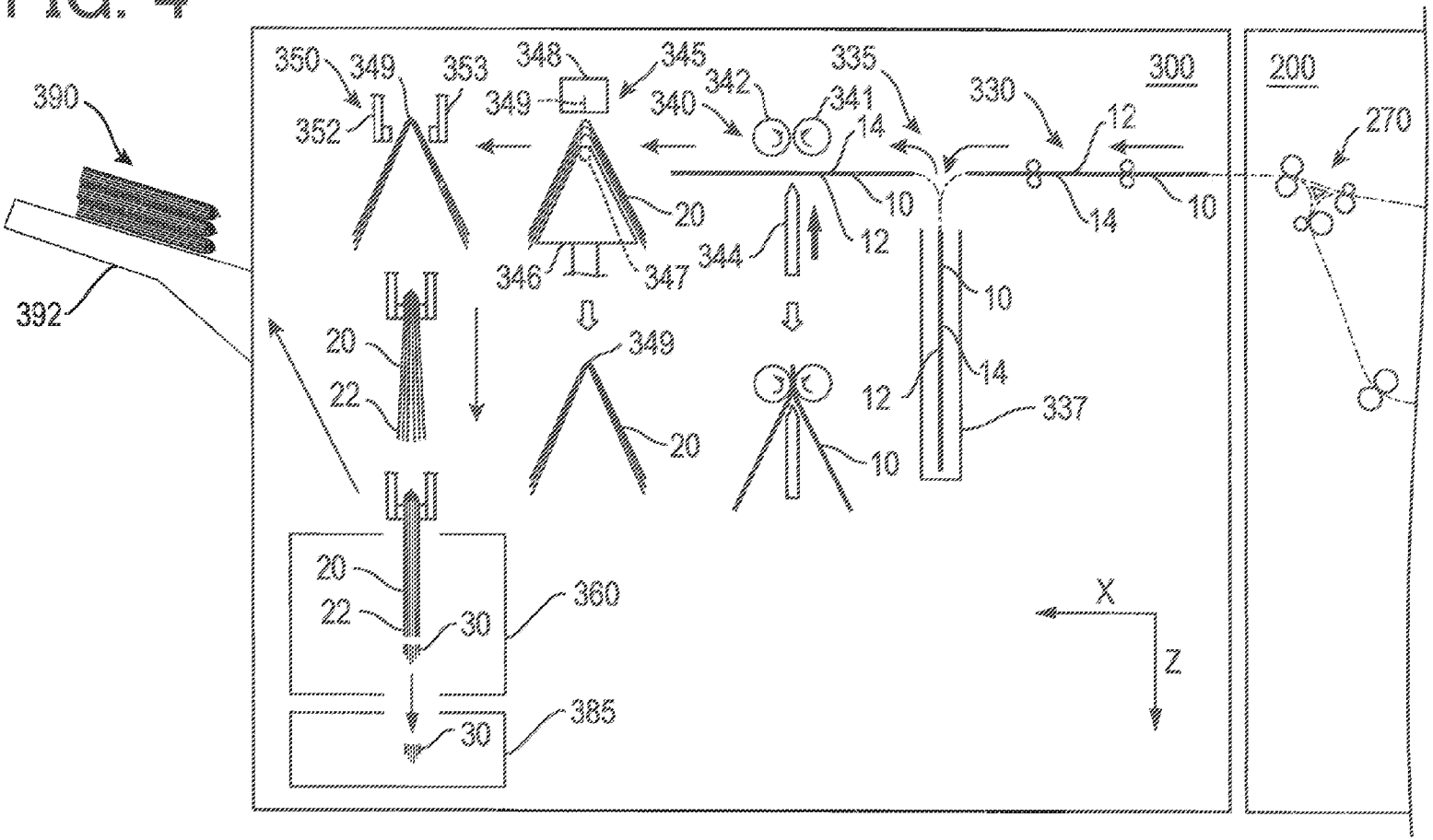
FIG. 4 is a schematic view of assistance in explaining the paper post-processing apparatus shown in FIG. 1.

FIG. 3 and FIG. 4 are a block diagram and a schematic view of assistance in explaining the paper post-processing apparatus shown in FIG. 1.

As shown in FIG. 3, the paper post-processing apparatus 300 has a control unit 310, a storage unit 320, a paper carrying-in unit 330, a paper reversing unit 335, a center folding unit 340, a saddle stitching unit 345, a paper bundle conveying unit 350, a cutting unit 360, a cutting waste receiving unit 385, a paper discharge unit 390, and a communication interface unit 395, and these are communicably connected to one another by a bus 305.

The control unit 310 is a control circuit including a microprocessor, etc., which perform control of each element and various types of operation processing according to programs, and each function of the paper post-processing apparatus 300 is exhibited when the control unit 310 executes programs corresponding to each function according to an instruction from the control unit 210 of the image forming apparatus 200.

The storage unit 320 is used for storing various programs and various pieces of data, and is configured by an appropriate combination of ROM, RAM, a rewritable nonvolatile memory, a hard disk drive device, etc.

The stored program, for example, is a bookbinding program 322 and a cutting program 324 which are started by an instruction from the post-processing setting program 224. The bookbinding program 322 is used for controlling each element of the paper post-processing apparatus 300, to form a paper bundle 20 by stacking a plurality of papers 10 on which an image has been formed, and to perform a saddle stitch bookbinding processing on the paper bundle by using a staple needle. The cutting program 324 is used for cutting an end portion 22 of the paper bundle 20 subjected to the saddle stitch bookbinding processing. In addition, in the present embodiment, the end portion 22 of the paper bundle 20 is an edge which is a free end opposite to a saddle stitching portion of the paper bundle 20. The cutting program 324 includes a pressing release control part, a reach determination control part, and a movement control part. The pressing release control part controls a driving unit 365 such that pressing by a pressing member 363 is released after the end portion 22 of the paper bundle 20 pressed by the pressing member 363 is cut by a cutting blade 368. The reach determination control part determines whether a front end portion 371A of a removal member 370 reaches the pressing member 363 at a position of the pressing member 363 when pressing by a receiving block 364 has been released by the pressing release control part. When the reach determination control part determines that the front end portion 371A of the removal member 370 has not reached the pressing member 363, the movement control part controls the driving unit 365 to move the pressing member 363 at a position at which the front end portion 371A of a removal member 370 reaches the pressing member 363 after the paper bundle 20 is taken out. As shown in FIG. 4, the paper carrying-in unit 330 is used for receiving papers from the paper carrying-out unit 270 of the image forming apparatus 200, and to convey the papers toward the paper reversing unit 335.

The paper reversing unit 335 has a waiting part 337 which stops the entire paper 10 once in a state along a vertical direction Z, and is used for reversing (turning over) the paper 10 from the paper carrying-in unit 330, and for example, to allow an image-formed surface to be positioned inward when the center is folded.

In detail, as shown in FIG. 4, the paper 10 is moved down in the vertical direction Z perpendicular to a conveyance direction X, and the entire paper 10 is positioned in the waiting part 337. Thereafter, the paper 10 is moved up in the vertical direction Z and conveyed to a downstream side of the conveyance direction X. In this way, a first surface 12 positioned on the surface and a second surface 14 positioned on the rear surface of the paper 10 before the paper 10 is put into the paper reversing unit 335 are reversed (turned over) in the paper reversing unit 335, and are positioned on the rear surface and the surface of the paper 10 at the time point at which the paper 10 is carried out from the paper reversing unit 335.

The center folding unit 340 has a pair of rollers 341 and 342 rotating in opposite directions, and a protruding member 344 positioned between the rollers 341 and 342, and is used for giving a fold to the paper 10 and fold the paper 10 in the center. In detail, the center portion of the paper 10 in the conveyance direction X is positioned below the rollers 341 and 342, and then the protruding member 344 presses the paper 10 from the rear surface side of the paper 10 toward between the rollers 341 and 342. In this way, the center portion of the paper 10 is nipped by the rollers 341 and 342 in a state in which the center portion of the paper 10 has been supported by the protruding member 344, and the fold is formed, so that the paper 10 is folded in the center.

The saddle stitching unit 345 has a saddle stand part 346, a needle receiving mechanism 347, and a stapling mechanism part 348 with a staple needle 349, and is used for saddle-stitching the paper bundle 20 (a stacked body of a plurality of papers 10 which have been folded in the center) placed on the saddle stand part 346. In detail, the paper bundle 20 is disposed on the saddle stand part 346 having two guide surfaces perpendicular to each other. Then, in a state in which the fold of the paper bundle 20 is elastically supported by the needle receiving mechanism 347 disposed in the vicinity of an apex of the saddle stand part 346, the needle receiving mechanism 347 is moved up toward the stapling mechanism part 348 disposed above the fold of the paper bundle 20. In this way, the fold of the paper bundle 20 is pressed by (abuts) the stapling mechanism part 348 and is saddle-stitched by the staple needle 349 held by the stapling mechanism part 348.

The paper bundle conveying unit 350 has a pair of arms 352 and 353 configured to approach each other and separate from each other, and is used for conveying and holding (supporting) the saddle-stitched paper bundle 20. In detail, in a state in which a back cover part of the saddle-stitched paper bundle 20 is nipped by the arms 352 and 353, the arms 352 and 353 convey the saddle-stitched paper bundle 20 from the saddle stitching unit 345 to the cutting unit 360, and then support (hold) the saddle-stitched paper bundle 20 during cutting in the cutting unit 360 and convey the saddle-stitched paper bundle 20 to the paper discharge unit 390 after the cutting.

The cutting unit 360 is used for cutting an end portion (an edge) 22 of the saddle-stitched paper bundle 20. In this way, since the edge becoming uneven by the number of papers 10 constituting the paper bundle 20 is cut, the external appearance of the paper bundle 20 is improved. A detailed configuration of the cutting unit 360 will be described later with reference to FIG. 5 and FIG. 6.

The cutting waste receiving unit 385 is used for receiving cutting waste 30 cut from the saddle-stitched paper bundle 20 in the cutting unit 360. The cutting waste receiving unit 385 is configured to be disposed directly under the cutting unit 360, and to receive the cutting waste 30 falling by its own weight.

The paper discharge unit 390 has a paper discharge tray 392 disposed on the outside of the paper post-processing apparatus 300, and is used for discharging the paper bundle 20 (the saddle-stitched paper bundle) conveyed from the cutting unit 360.

The communication interface unit 395 is used for transmitting/receiving data to/from the image forming apparatus 200. The data is control data or post-processing setting data required in order to perform a post-processing job (a bookbinding job and a cutting job) in the paper post-processing apparatus 300.

The paper post-processing apparatus 300 is not limited to the aforementioned configuration, and for example, a square fold processing unit, which performs square fold processing (square back processing) for shaping the back cover part of a stitched paper bundle, a top and bottom cutting processing unit for cutting the top and bottom of a saddle-stitched paper bundle, a Z-folding processing unit for bending a paper twice in a Z shape when viewed from an extension line direction of a fold, a punching processing unit for punching a hole for filing in an end portion of a paper, a side stitching processing unit for binding a portion of about 5 mm from an end of a paper bundle as a binding margin by a staple needle, etc., can also be appropriately incorporated.

Next, the cutting unit 360 will be described in detail.

Figure 5:
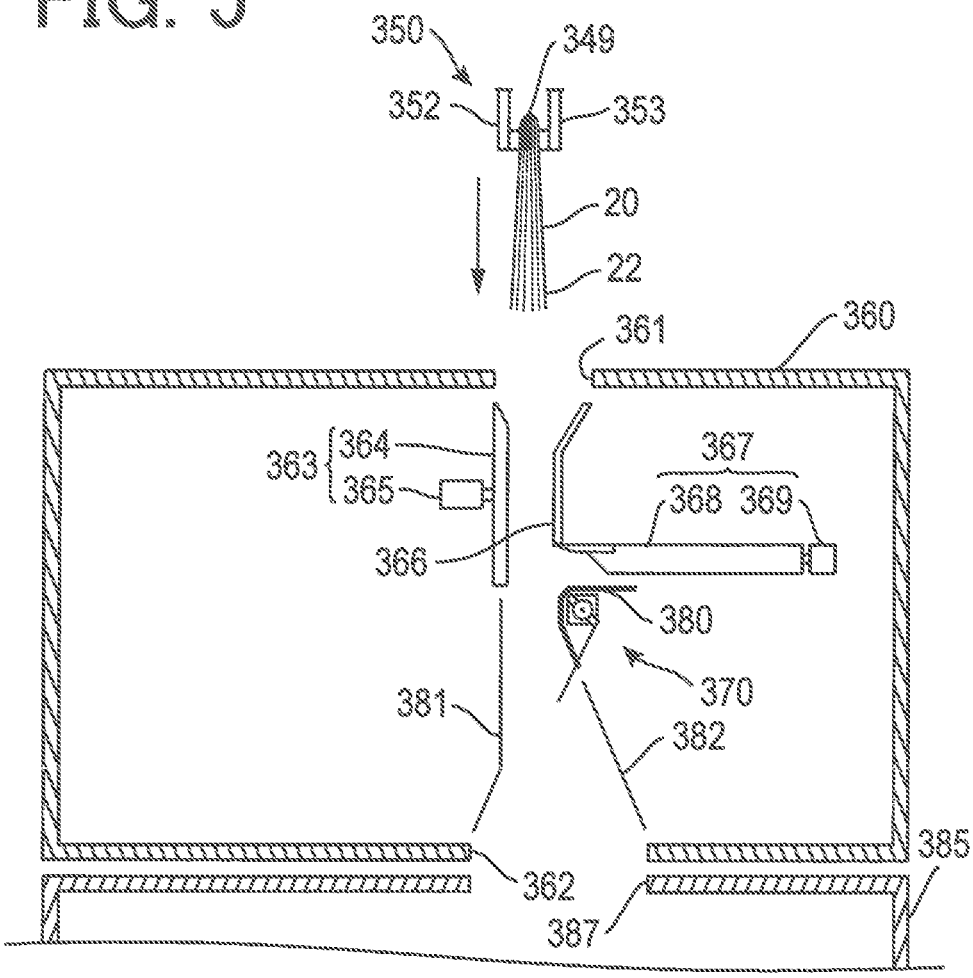
FIG. 5 is a schematic view of assistance in explaining a cutting unit shown in FIG. 3 and FIG. 4.
Figure 6:
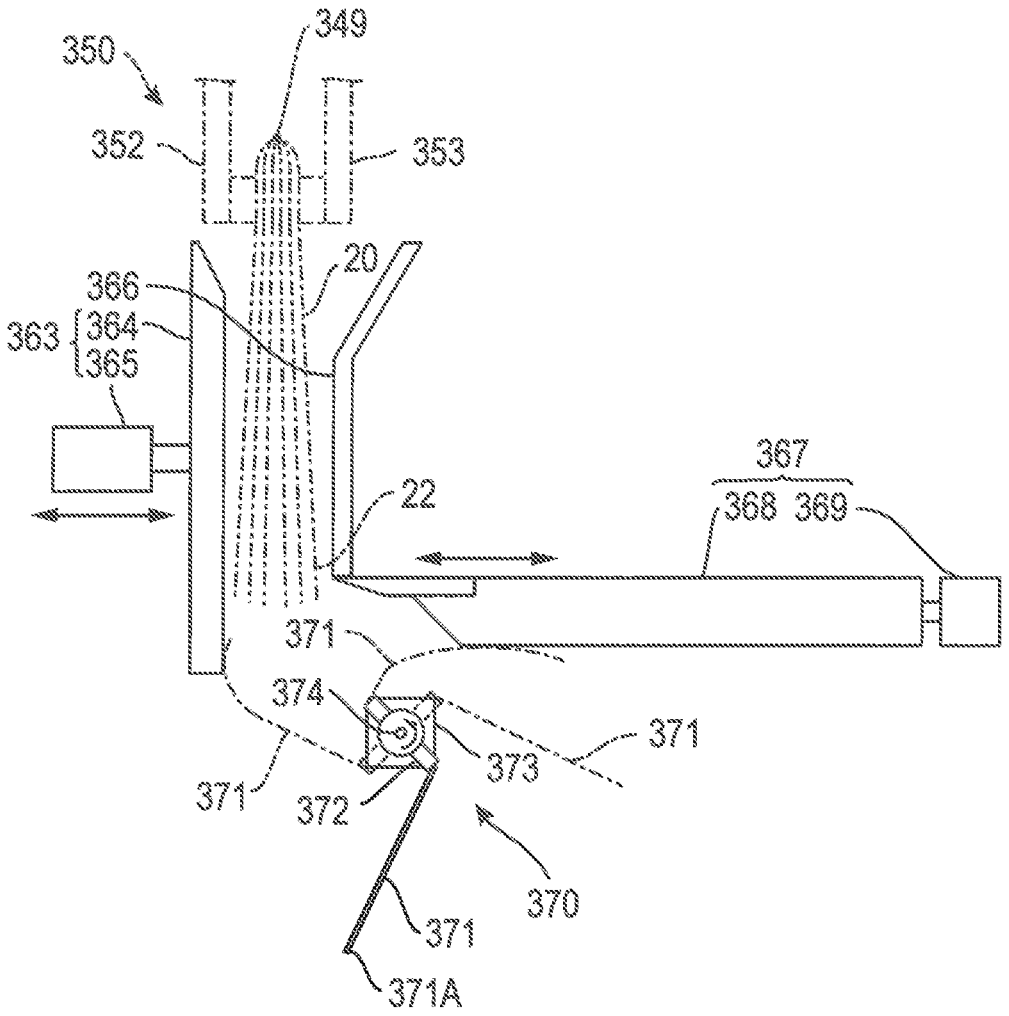
FIG. 6 is a schematic view of assistance in explaining main elements of the cutting unit.

FIG. 5 is a schematic view of assistance in explaining the cutting unit 360 shown in FIG. 3 and FIG. 4, and FIG. 6 is a schematic view of assistance in explaining main elements of the cutting unit 360.

As shown in FIG. 5, the cutting unit 360 has a paper bundle insertion port 361, a cutting waste discharge port 362, a pressing member 363, a support member 366, a cutting mechanism 367, a removal member 370, and guide members 380, 381 and 382.

The paper bundle insertion port 361 is an opening for inserting the paper bundle 20 conveyed by the arms 352 and 353 of the paper bundle conveying unit 350 into an inner side of the cutting unit 360.

The cutting waste discharge port 362 is aligned with a cutting waste receiving port 387 of the cutting waste receiving unit 385, and is used for receiving the cutting waste 30 (see FIG. 4) generated by cutting the end portion 22 of the paper bundle 20 in the cutting waste receiving unit 385.

The pressing member 363 has the receiving block 364 and the driving unit 365. The pressing member 363 has a function of approaching and pressing the inserted paper bundle 20.

The receiving block 364 is configured to freely approach and separate from the inserted paper bundle 20, and also serves as a blade receiving part of the cutting blade 368.

The driving unit 365 is used for driving and positioning the receiving block 364 at a large number paper bundle receiving position, a large number paper bundle takeout position, a small number paper bundle receiving position, a small number paper bundle takeout position, a paper bundle pressing position, and a waiting position. In addition, in the present embodiment, when the number of papers constituting the paper bundle 20 is equal to or more than 10, the control unit 310 determines that the paper bundle 20 is a large number paper bundle, and when the number of papers is smaller than 10, the control unit 310 determines that the paper bundle 20 is a small number paper bundle.

The support member 366 is configured to be fixed, to be aligned with the receiving block 364, and to freely clamp the paper bundle 20, which is inserted into a space formed between the support member 366 and the receiving block 364, in cooperation with the pressing member 363.

In addition, a method in which the control unit 310 determines whether the paper bundle 20 is a large number paper bundle or a small number paper bundle is not limited to the aforementioned method. For example, it is also possible to perform the determination based on the thickness of the paper bundle 20. The thickness of the paper bundle 20 can be calculated based on the type and the number of papers constituting the paper bundle 20. Furthermore, it is possible to provide a sensor (not shown) for detecting the length of the paper bundle 20 in a thickness direction in the paper post-processing apparatus 300, and calculate the thickness of the paper bundle 20 based on a detection result of the sensor. Then, when the thickness of the paper bundle 20 is equal to or more than predetermined thickness, the paper bundle 20 is called a large number paper bundle, and when the thickness of the paper bundle 20 is smaller than the predetermined thickness, the paper bundle 20 is called a small number paper bundle.

The large number paper bundle receiving position is a position of the receiving block 364 for inserting a large number paper bundle conveyed by the arms 352 and 353 of the paper bundle conveying unit 350 into the space formed between the receiving block 364 and the support member 366. The large number paper bundle takeout position is a position of the receiving block 364 for taking out a large number paper bundle, from which an end portion 22 has been cut, from the space formed between the receiving block 364 and the support member 366 by the arms 352 and 353 of the paper bundle conveying unit 350.

The small number paper bundle receiving position is a position of the receiving block 364 for inserting a small number paper bundle conveyed by the arms 352 and 353 of the paper bundle conveying unit 350 into the space formed between the receiving block 364 and the support member 366. The small number paper bundle takeout position is a position of the receiving block 364 for taking out a small number paper bundle, from which an end portion 22 has been cut, from the space formed between the receiving block 364 and the support member 366 by the arms 352 and 353 of the paper bundle conveying unit 350.

The paper bundle pressing position is a position at which the receiving block 364 abuts the paper bundle 20 to apply pressing force, and changes in response to the number of papers constituting the paper bundle 20. The pressing force is set such that position shift or torsion of the paper bundle 20 (or the papers constituting the paper bundle 20) is prevented from occurring at the time of cutting. In addition, when the receiving block 364 abuts the paper bundle 20 to apply pressing force, the rear surface of the paper bundle 20 is supported by the fixed type support member 366.

The waiting position is a home position of the receiving block 364. In addition, in the present embodiment, since the small number paper bundle receiving position, the small number paper bundle takeout position, and the waiting position are the same position, they are called a first position in the following description. Furthermore, since the large number paper bundle receiving position and the large number paper bundle takeout position are the same position, they are called a second position in the following description.

The cutting mechanism 367 has the cutting blade 368 and a driving unit 369.

The cutting blade 368 is used for cutting the end portion 22 of the paper bundle 20 pressed by the receiving block 364 at the paper bundle pressing position. The driving unit 369 is used for driving the cutting blade 368 to generate shear force for cutting the end portion 22 of the paper bundle 20. In addition, from the standpoint of cutting the end portion 22 of the paper bundle 20 by relatively small driving force, it is preferable to allow the cutting blade 368 to abut the end portion 22 of the paper bundle 20 while sliding the cutting blade 368 in a direction perpendicular to both the conveyance direction X and the vertical direction Z.

As shown in FIG. 6, the removal member 370 has a paddle 371, a base 372, and a driving unit 373. The removal member 370 has a function of removing the cutting waste.

The paddle 371 has a front end portion 371A for removing the cutting waste of the paper bundle 20. The paddle 371 is fixed to the base 372, and the base 372 is configured to freely rotate about a shaft 374. The driving unit 373 is, for example, composed of a motor which rotates the shaft 374, and can rotate the paddle 371.

The length of the paddle 371 is set such that the front end portion 371A can reach the receiving block 364 and securely remove cutting waste attached to the receiving block 364 at the first position of the receiving block 364 (corresponding to the small number paper bundle receiving position, the small number paper bundle takeout position, and the waiting position). On the other hand, at the second position of the receiving block 364 (corresponding to the large number paper bundle receiving position and the large number paper bundle takeout position), the front end portion 371A of the paddle 371 does not reach the receiving block 364. Accordingly, the case in which the receiving block 364 is positioned at the second position after the cutting of the paper bundle 20 is performed, that is, in the case of performing the cutting of a large number paper bundle, it is configured that the receiving block 364 is, after the paper bundle 20 is taken out, driven to move to the first position at which the front end portion 371A of the paddle 371 reaches the receiving block 364. An operation in this case will be described later with reference to FIG. 12 to FIG. 17.

Accordingly, for example, when the receiving block 364 is disposed at the second position at which the front end portion of the paddle 371 does not reach the receiving block 364 because the number of papers constituting the paper bundle 20 is large and the thickness of the paper bundle 20 is large, the driving unit 373 can move the receiving block 364 to the first position, at which the front end portion 371A of the paddle 371 reaches the receiving block 364, after the paper bundle 20 is taken out. In this way, the cutting waste attached to the receiving block 364 is removed by the front end portion of the paddle 371 which is rotated. Consequently, even though the thickness of a paper bundle is large, it is possible to securely remove the cutting waste of the paper bundle.

The paddle 371 is made of an elastic (flexible) thin plate and is a thin plate made of polyurethane of about 1 mm, for example. In addition, it is also permissible to install a plurality of the removal members 370. Furthermore, a plurality of paddles 371 may also be fixed to the base 372.

Preferably, whenever cutting of one paper bundle 20 is performed, the paddle 371 is rotated a plurality of times such that the cutting waste of the paper bundle 20 is repeatedly removed by the front end portion 371A, and in this way, it is possible to securely remove the cutting waste.

The guide members 380, 381 and 382 are used for guiding the cutting waste toward the cutting waste discharge port 362. It is preferable to use, as the guide members 380, 381 and 382, a member obtained by forming a resin material containing an electrically conducting material into a sheet shape as a measure to static electricity. The resin material, for example, is polyamide resin, polyvinylchloride resin (PVC), polyethylene-terephthalate resin (PET), or polycarbonate resin. The electrically conducting material, for example, is carbon, metal, or metal oxide. In addition, in subsequent drawings after FIG. 6, for the purpose of simplification of drawings, the guide members 380, 381 and 382 are not shown.

Next, an operation of the cutting unit 360 will be described.

Figure 7:
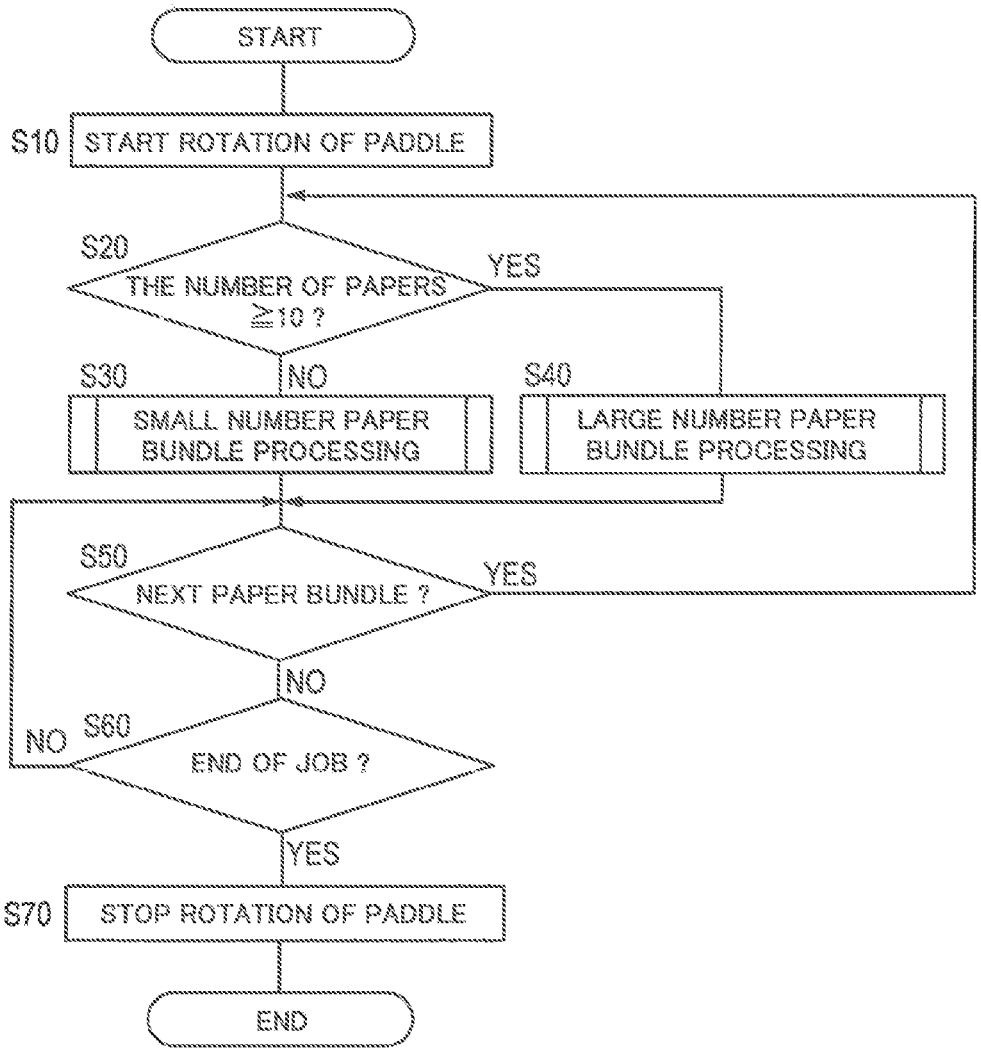
FIG. 7 is a flowchart of assistance in explaining an operation of the cutting unit.
Figure 8:
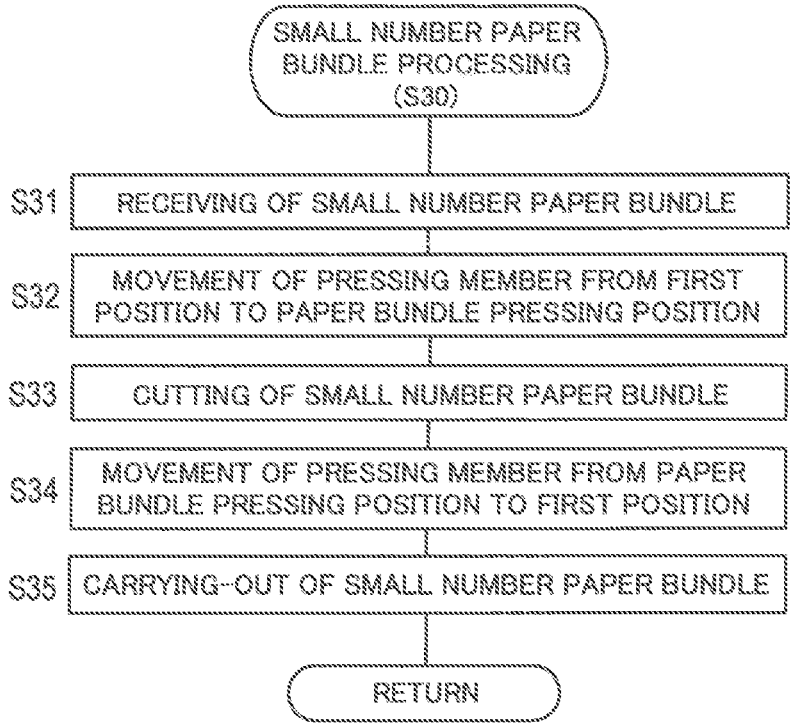
FIG. 8 is a flowchart of assistance in explaining a small number paper bundle processing shown in FIG. 7.
Figure 12:
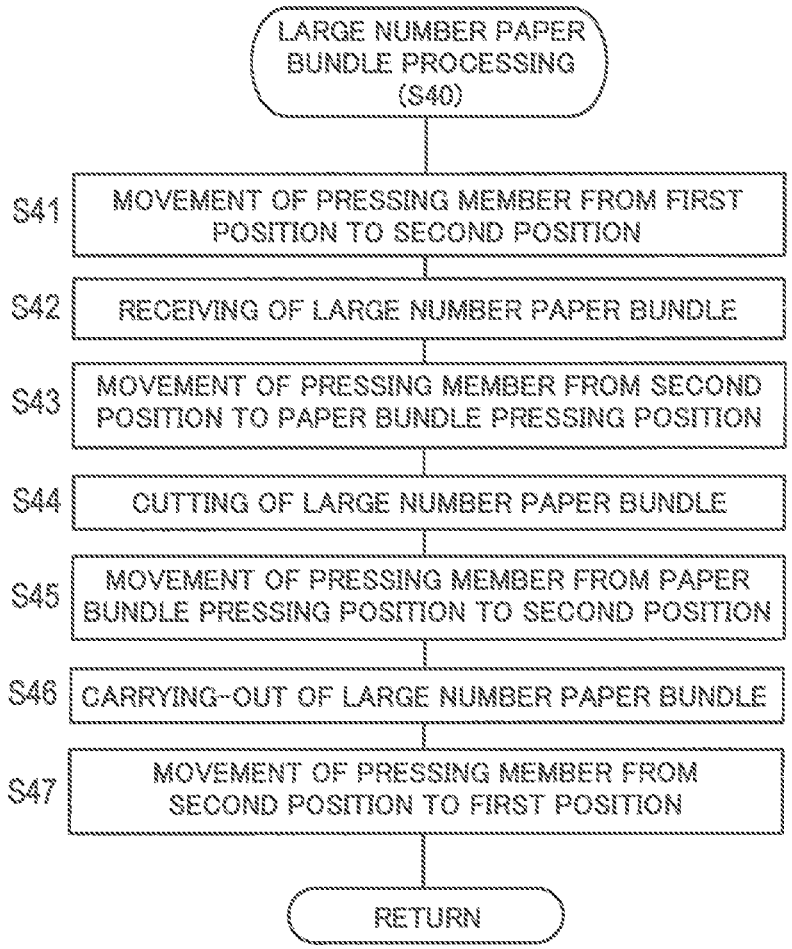
FIG. 12 is a flowchart of assistance in explaining a large number paper bundle processing shown in FIG. 7.

FIG. 7 is a flowchart of assistance in explaining the operation of the cutting unit 360. In addition, algorithms indicated by flowcharts shown in FIG. 7 and in aftermentioned FIGS. 8 and 12 are stored in the storage unit 320 as the cutting program 324 and is executed by the control unit 310.

Firstly, when a post-processing job (a cutting job) start signal is received, the driving unit 373 starts to rotate the paddle 371 (step S10).

Then, it is determined whether the paper bundle 20 conveyed by the arms 352 and 353 of the paper bundle conveying unit 350 is a large number paper bundle (step S20). In detail, for example, it is determined whether the number of papers constituting the paper bundle 20 is equal to or more than 10 (the reach determination control part).

When the control unit 310 determines that the paper bundle 20 is not the large number paper bundle (is a small number paper bundle) (step S20: NO), a small number paper bundle processing is performed (step S30), and the process advances to step S50. Here, the small number paper bundle processing indicates a processing of cutting a small number paper bundle. On the other hand, when it is determined that the paper bundle 20 is the large number paper bundle (step S20: YES), a large number paper bundle processing is performed (step S40), and the process advances to step S50. Here, the large number paper bundle processing indicates a processing of cutting a large number paper bundle.

In step S50, it is determined whether there is a next paper bundle 20. When the next paper bundle 20 exists (step S50: YES), the process advances to step S20 and the aforementioned steps are repeated.

When it is determined that there is no next paper bundle 20 (step S50: NO), it is determined whether the post-processing job (the cutting job) is ended (step S60). When it is determined that the post-processing job is not ended (step S60: NO), the process advances to step S50 and the aforementioned steps are repeated. On the other hand, when it is, for example, determined that the post-processing job is ended based on the reception of an end signal (step S60: YES), rotating the paddle 371 is stopped and the process is ended.

Next, the small number paper bundle processing (step S30) will be described in detail.

FIG. 8 is a flowchart of assistance in explaining the small number paper bundle processing shown in FIG. 7, and FIGS. 9, 10 and 11 are schematic views of assistance in explaining the receiving of a small number paper bundle in step S31, the cutting of the small number paper bundle in step S33 and the carrying-out of the small number paper bundle in step S35 shown in FIG. 8, respectively.

In the small number paper bundle processing, as shown in FIG. 8, the receiving of the small number paper bundle (step S31), the movement of the pressing member from the first position to the paper bundle pressing position (step S32), the cutting of the small number paper bundle (step S33), the movement of the pressing member from the paper bundle pressing position to the first position (step S34), and the carrying-out of the small number paper bundle (step S35) are performed.

Figure 9:
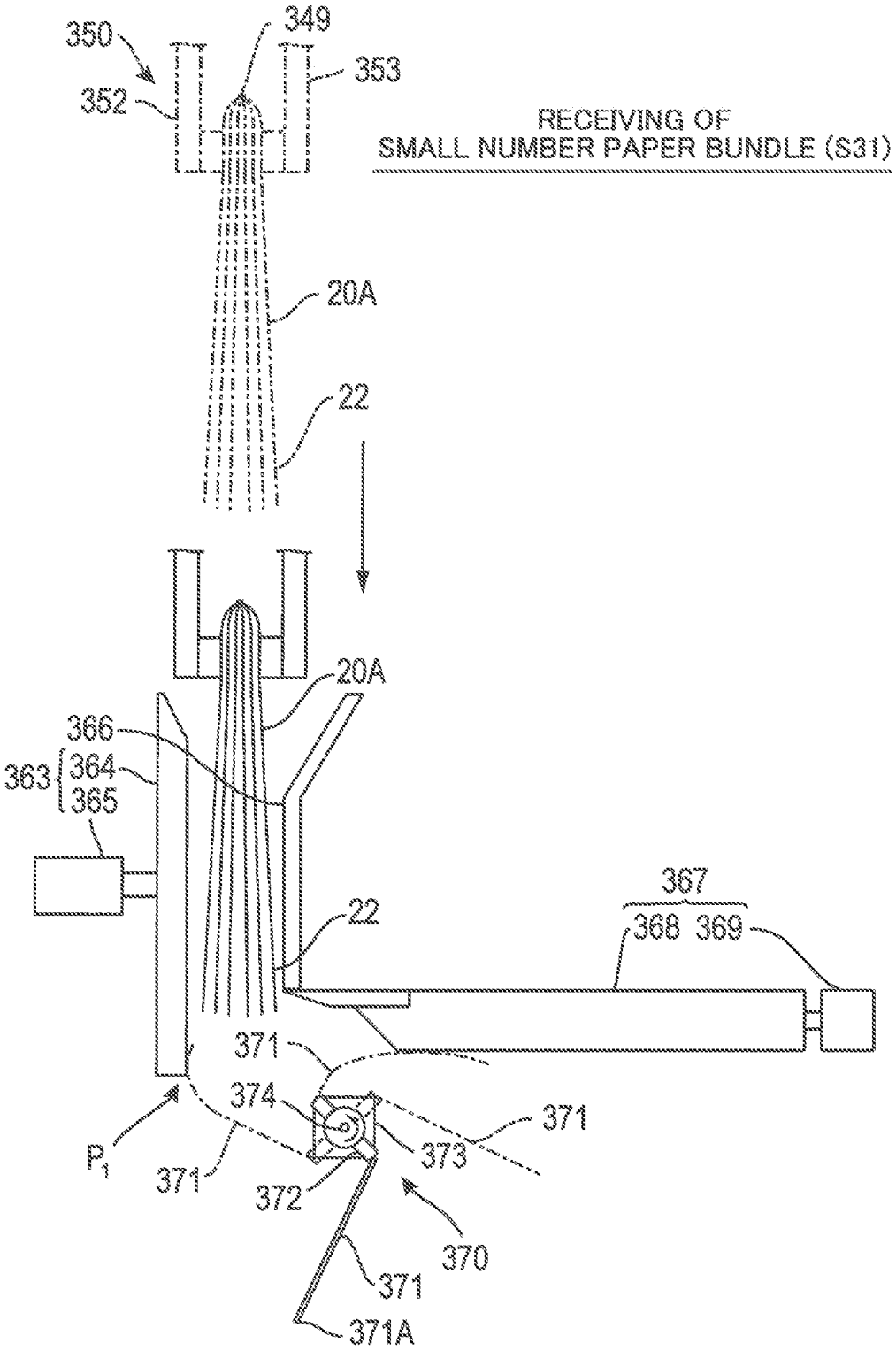
FIG. 9 is a schematic view of assistance in explaining the receiving of a small number paper bundle in step S31 shown in FIG. 8.

In detail, in step S31, as shown in FIG. 9, the arms 352 and 353 of the paper bundle conveying unit 350 move downward, so that a small number paper bundle 20A held by the arms 352 and 353 is inserted into a space formed between the pressing member 363 and the support member 366 through the paper bundle insertion port 361 (see FIG. 5).

At this time, the pressing member 363 is positioned at the first position $P_1$. That is, the waiting position of the pressing member 363 and the small number paper bundle receiving position are the same position. Therefore, the space between the pressing member 363 and the support member 366 is ready to receive the small number paper bundle 20A. Furthermore, before the small number paper bundle 20A is received, the paddle 371 is in operation. Consequently, even though cutting waste of a previous job remains in the pressing member 363, a bad influence on a current job is excluded because the cutting waste is removed by the front end portion 371A of the paddle 371 before the small number paper bundle 20A is received.

In step S32, the pressing member 363 is driven by the driving unit 365, moves to the paper bundle pressing position $P_P$, and presses the small number paper bundle 20A.

Figure 10:
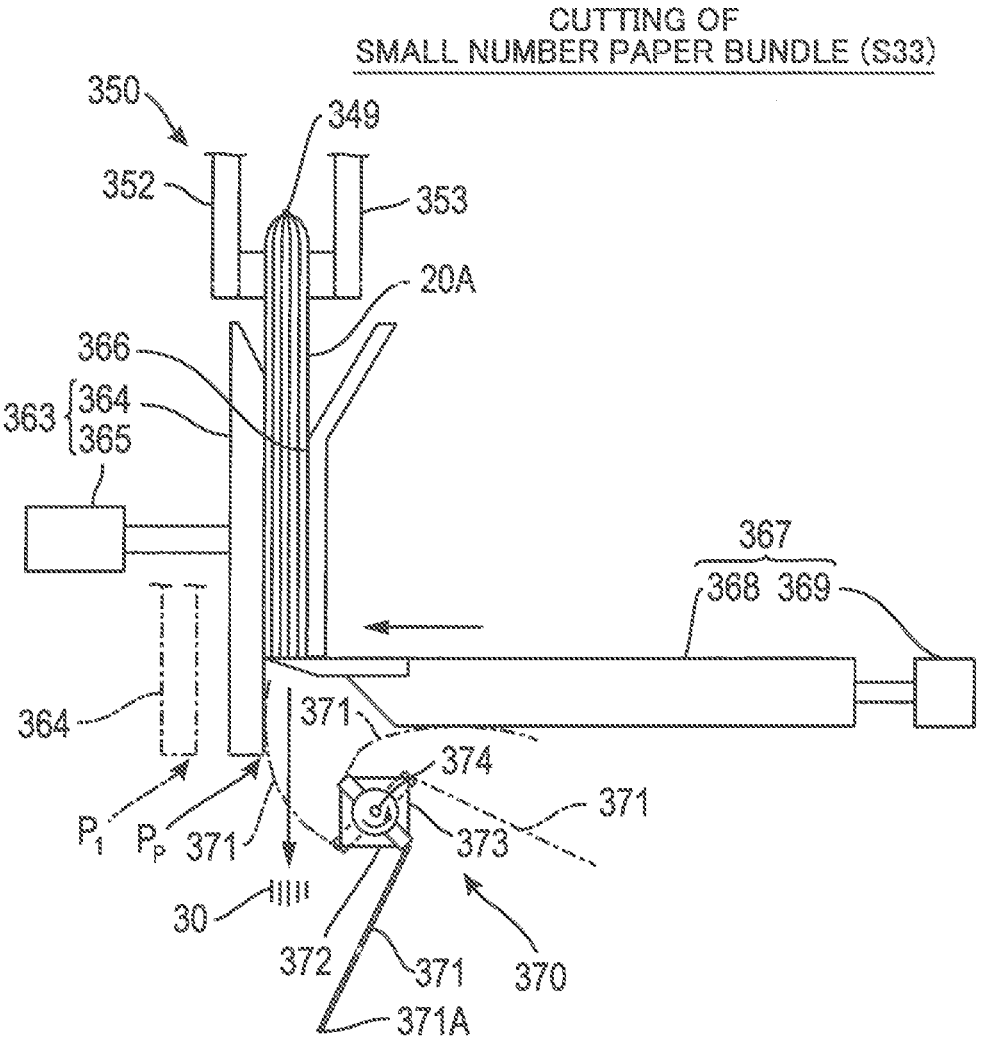
FIG. 10 is a schematic view of assistance in explaining the cutting of the small number paper bundle in step S33 shown in FIG. 8.

In step S33, as shown in FIG. 10, the cutting blade 368 is driven by the driving unit 369 toward the small number paper bundle 20A and cuts the end portion 22 of the small number paper bundle 20A. At this time, since the front end portion 371A of the paddle 371 which is rotated reaches the pressing member 363 which presses the small number paper bundle 20A, cutting waste 30 generated during the cutting is efficiently removed. The cutting waste 30 of the small number paper bundle 20A, which is removed by the paddle 371 or falls down by its own weight, is guided by the guide members 380, 381 and 382, and is stored inside the cutting waste receiving unit 385 through the cutting waste discharge port 362 and the cutting waste receiving port 387 of the cutting waste receiving unit 385 (see FIG. 5).

In step S34, in order to carry out the small number paper bundle 20A which has been cut, the pressing member 363 is driven by the driving unit 365, and moves to the first position $P_1$ from the paper bundle pressing position $P_P$, so that the pressing (restraint) of the small number paper bundle 20A is released.

Figure 11:
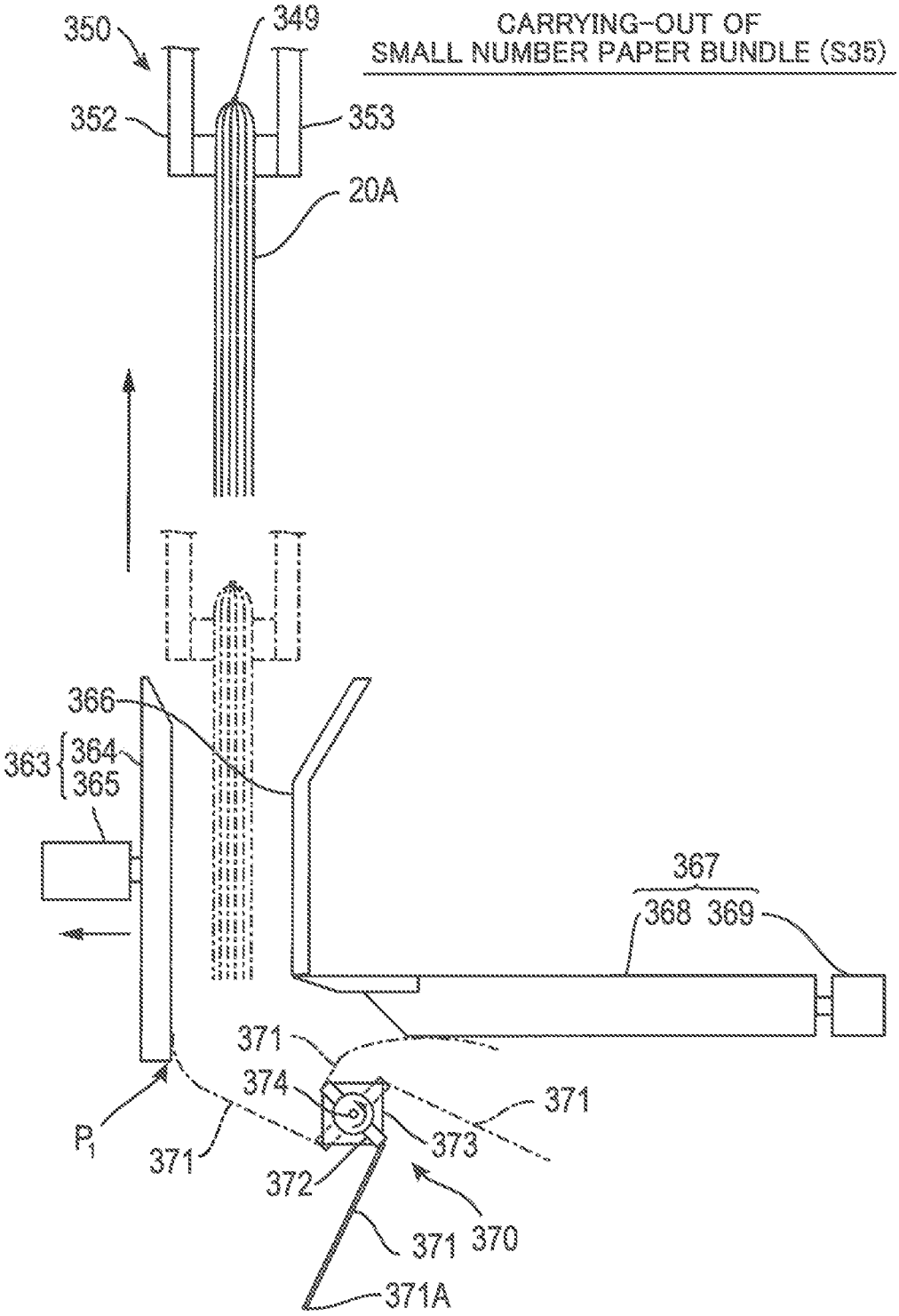
FIG. 11 is a schematic view of assistance in explaining the carrying-out of the small number paper bundle in step S35 shown in FIG. 8.

In step S35, as shown in FIG. 11, the arms 352 and 353 of the paper bundle conveying unit 350 move upward, so that the small number paper bundle 20A held by the arms 352 and 353 is taken out from the cutting unit 360 and is conveyed toward the paper discharge unit.

In addition, also in step S34 and step S35, since rotating the paddle 371 is continued, cutting waste which remains in the pressing member 363 even after the cutting, is securely removed.

Next, the large number paper bundle processing (step S40) will be described in detail.

FIG. 12 is a flowchart of assistance in explaining the large number paper bundle processing shown in FIG. 7, and FIGS. 13, 14, 15, 16, and FIG. 17 are schematic views of assistance in explaining the movement of the pressing member from the first position to the second position in step S41, the receiving of a large number paper bundle in step S42, the cutting of the large number paper bundle in step S44, the carrying-out of the large number paper bundle in step S46, and the movement of the pressing member from the second position to the first position in step S47 shown in FIG. 12, respectively.

In the large number paper bundle processing, as shown in FIG. 12, the movement of the pressing member from the first position to the second position (step S41), the receiving of the large number paper bundle (step S42), the movement of the pressing member from the second position to the paper bundle pressing position (step S43), the cutting of the large number paper bundle (step S44), the movement of the pressing member from the paper bundle pressing position to the second position (step S45), the carrying-out of the large number paper bundle (step S46), and the movement of the pressing member from the second position to the first position (step S47) are performed.

Figure 13:
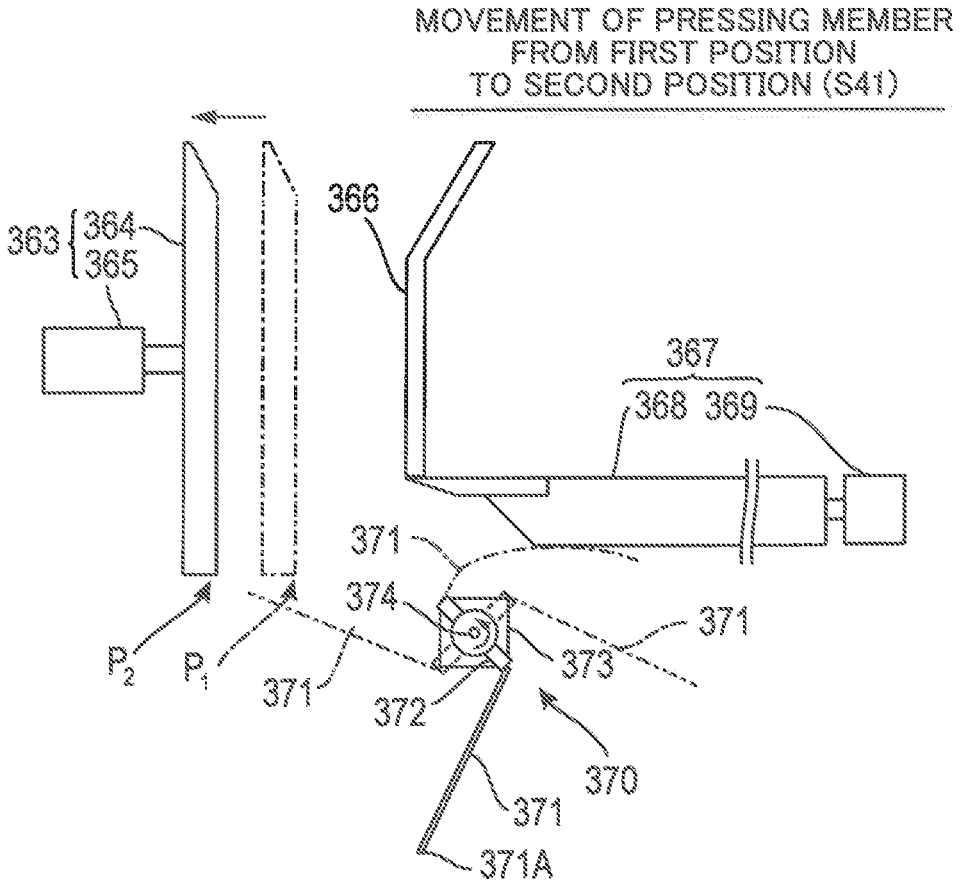
FIG. 13 is a schematic view of assistance in explaining the movement of a pressing member from a first position to a second position in step S41 shown in FIG. 12.

In detail, in step S41, in order to receive a large number paper bundle 20B, as shown in FIG. 13, the pressing member 363 is driven by the driving unit 365 and moves from the first position $P_1$ to a second position $P_2$ (the pressing release control part). At this time, the paddle 371 has been already rotated. That is, even just before the pressing member 363 moves to the second position $P_2$, the pressing member 363 is in a state of waiting at the first position $P_1$, and the paddle 371 is in operation. Consequently, even though cutting waste of a previous job remains in the pressing member 363, a bad influence on a current job is excluded because the cutting waste is removed by the front end portion 371A of the paddle 371 before the large number paper bundle 20B is received. In step S41, the pressing member 363 moves to the second position $P_2$, so that the space between the pressing member 363 and the support member 366 is in a state of receiving the large number paper bundle 20B.

Figure 14:
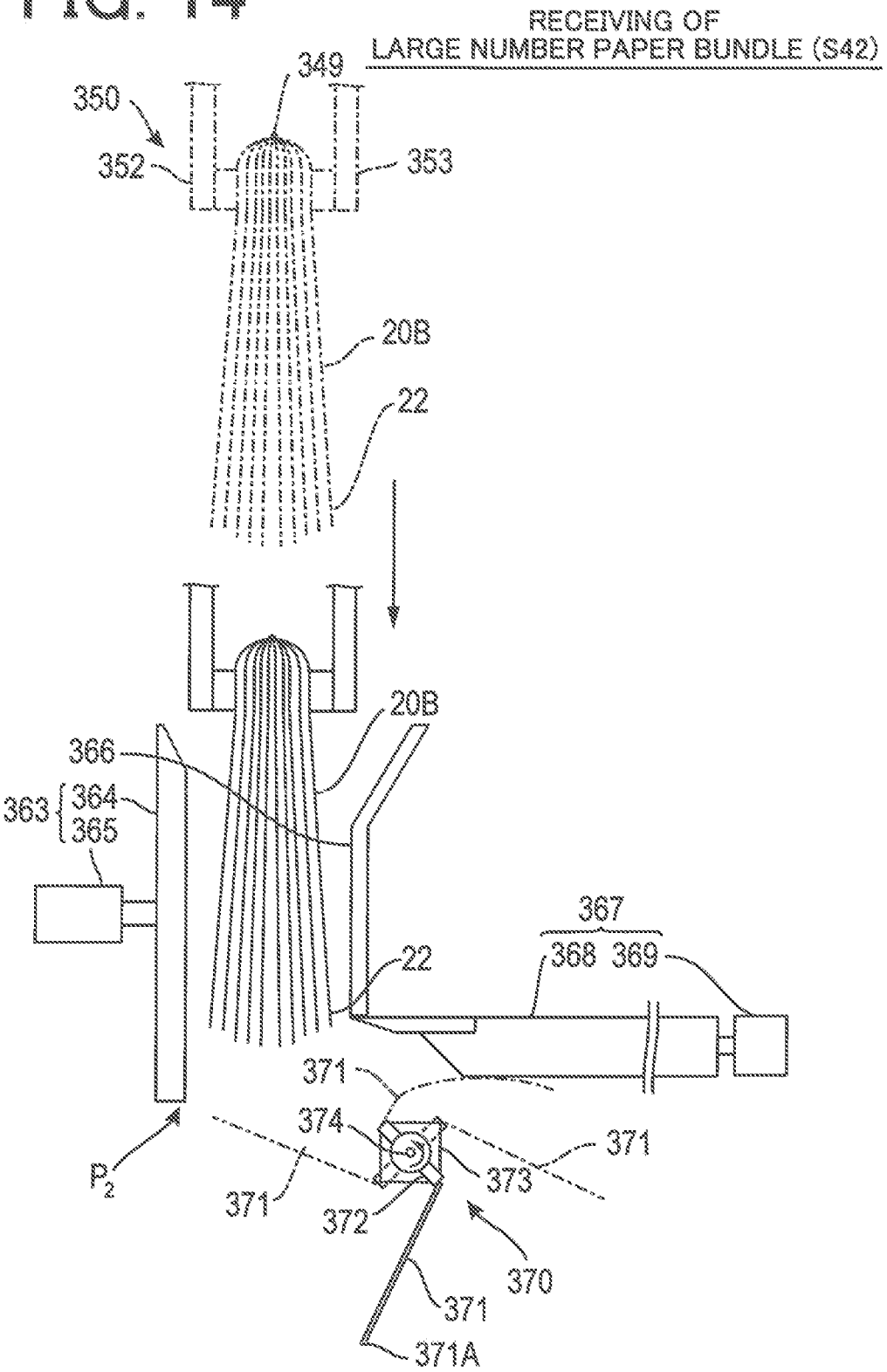
FIG. 14 is a schematic view of assistance in explaining the receiving of a large number paper bundle in step S42 shown in FIG. 12.

In step S42, as shown in FIG. 14, the arms 352 and 353 of the paper bundle conveying unit 350 move downward, so that the large number paper bundle 20B held by the arms 352 and 353 is inserted into the space formed between the pressing member 363 and the support member 366 through the paper bundle insertion port 361 (see FIG. 5).

In step S43, the pressing member 363 is driven by the driving unit 365, moves to the paper bundle pressing position $P_P$, and presses the large number paper bundle 20B. In a precise sense, the paper bundle pressing position $P_P$ when pressing the large number paper bundle 20B and the paper bundle pressing position $P_P$ when pressing the small number paper bundle 20A as shown in FIG. 10 are shifted from each other by a difference between the thicknesses of the paper bundles, but the same reference numerals are used for the purpose of simplification herein.

Figure 15:
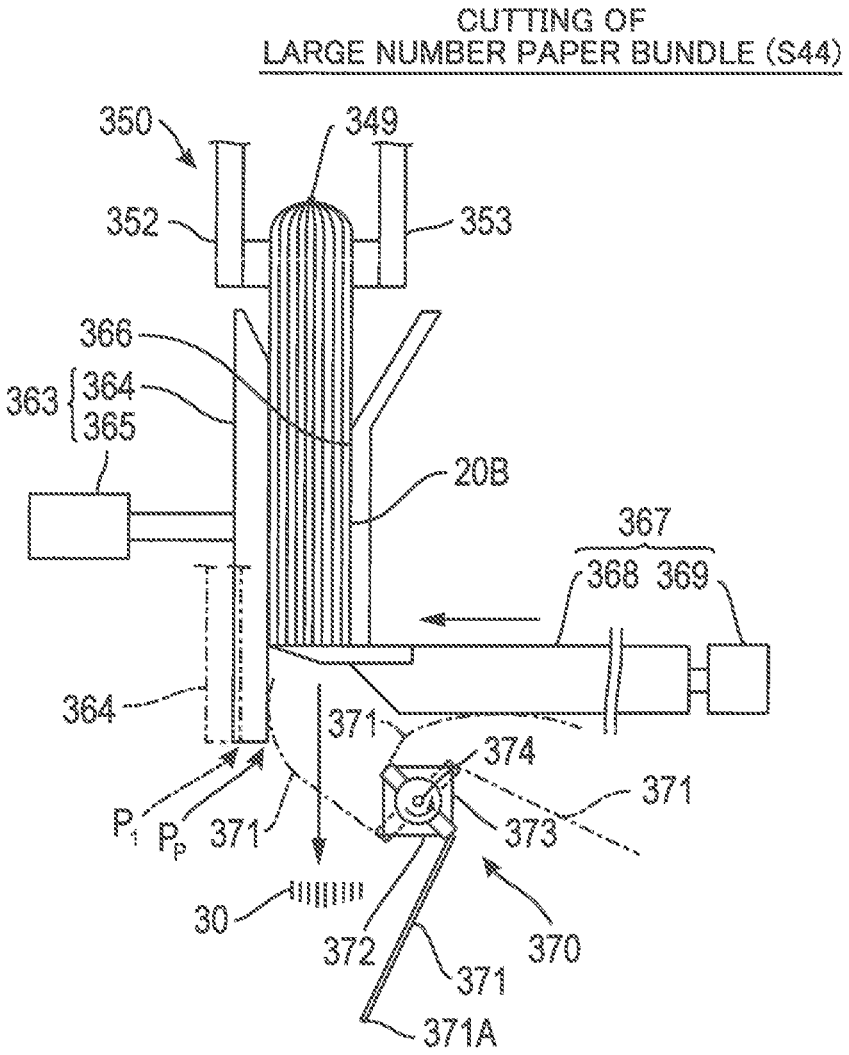
FIG. 15 is a schematic view of assistance in explaining the cutting of the large number paper bundle in step S44 shown in FIG. 12.

In step S44, as shown in FIG. 15, the cutting blade 368 is driven by the driving unit 369 toward the large number paper bundle 20B and cuts the end portion 22 of the large number paper bundle 20B. Cutting waste 30 of the large number paper bundle 20B, which is removed by the paddle 371 or falls downwards by its own weight, is guided by the guide members 380, 381 and 382, and is stored inside the cutting waste receiving unit 385 through the cutting waste discharge port 362 and the cutting waste receiving port 387 of the cutting waste receiving unit 385 (see FIG. 5). In addition, when the paper bundle pressing position $P_P$ is included in the range between the first position $P_1$ and the support member 366, the cutting waste 30 generated during the cutting is efficiently removed because the front end portion 371A of the paddle 371 reaches the pressing member 363 which presses the large number paper bundle 20B.

In step S45, in order to discharge the large number paper bundle 20B, the pressing member 363 is driven by the driving unit 365, and moves to the second position $P_2$ from the paper bundle pressing position $P_P$, so that the pressing (restraint) of the large number paper bundle 20B is released.

Figure 16:
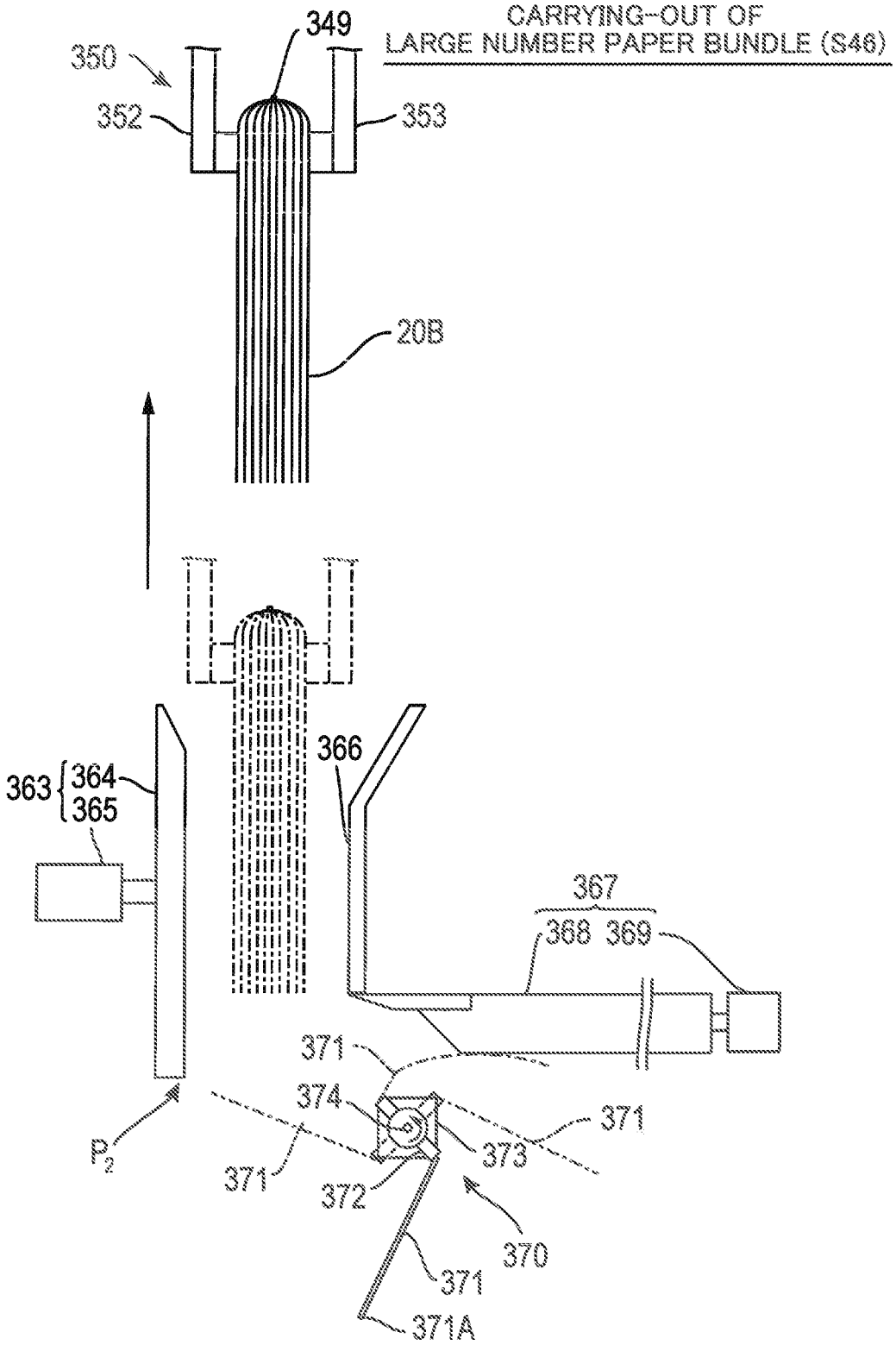
FIG. 16 is a schematic view of assistance in explaining the carrying-out of the large number paper bundle in step S46 shown in FIG. 12.

In step S46, as shown in FIG. 16, the arms 352 and 353 of the paper bundle conveying unit 350 move upward, so that the large number paper bundle 20B held by the arms 352 and 353 is taken out from the cutting unit 360 and is conveyed toward the paper discharge unit.

Figure 17:
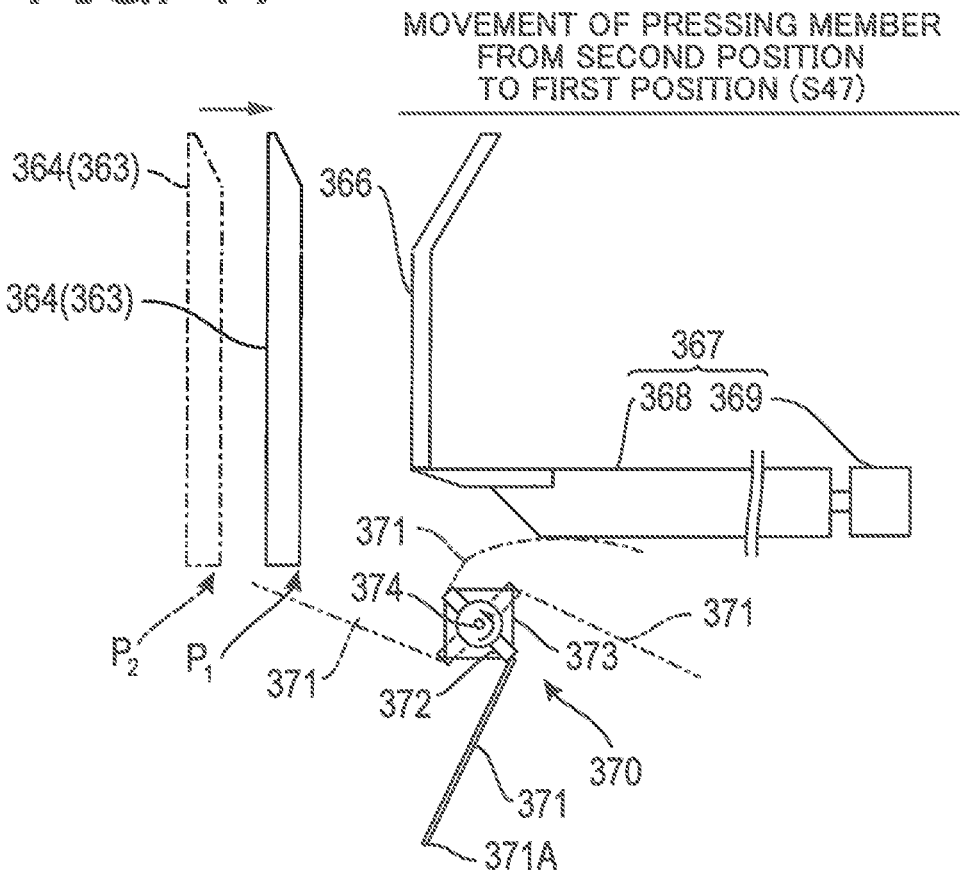
FIG. 17 is a schematic view of assistance in explaining the movement of the pressing member from the second position to the first position in step S47 shown in FIG. 12.

In step S47, as shown in FIG. 17, the pressing member 363 is driven by the driving unit 365, and moves to the first position $P_1$ as the waiting position from the second position $P_2$ (the movement control part). At this time, rotating the paddle 371 is continued. Consequently, even though the cutting waste 30 generated during the cutting remains in the pressing member 363, the cutting waste 30 is removed by the front end portion 371A of the paddle 371 after the large number paper bundle 20B is carried out. That is, even though the thickness of a paper bundle is large, it is possible to securely remove the cutting waste of the paper bundle.

In addition, in the present embodiment, the small number paper bundle receiving position, the small number paper bundle takeout position, and the waiting position are the same position (the first position), but they may also be positions different from one another. Similarly, in the present embodiment, the large number paper bundle receiving position and the large number paper bundle takeout position are the same position (the second position), but they may also be positions different from each other.

Furthermore, in the present embodiment, the support member 366 is fixed, but the pressing member 363 and the support member 366 can also be configured to freely approach each other and separate from each other (to be movable).

As described above, in accordance with the paper processing apparatus (the paper post-processing apparatus) and the image forming system according to the present embodiment, after the cutting blade cuts the end portion of a paper bundle, the control unit controls, when determining that the front end portion of the removal member does not reach the pressing member at a position of the pressing member which is in a state in which pressing by the pressing member has been released, the driving unit to move the pressing member to a position at which the front end portion of the removal member reaches the pressing member after the paper bundle is taken out. Consequently, the front end portion of the removal member securely removes cutting waste of the paper bundle, which has been attached to the pressing member. That is, it is possible to provide the paper processing apparatus and the image forming system which can securely remove cutting waste of a paper bundle, which is attached to the pressing member.

The present invention is not limited to the above embodiment, but can be modified in various forms within the range of the claims. For example, a paper bundle cut by the cutting blade is not limited to a saddle-stitched paper bundle. Furthermore, an end portion of the paper bundle cut by the cutting blade is not limited to an edge of the paper bundle. That is, the present invention can also be applied to the case of cutting the top and bottom of the paper bundle. Moreover, an image forming apparatus included in the image forming system can also be configured by MFP (Multi-Function Peripheral). Furthermore, the configuration of the removal member is not limited to the rotary paddle type as described above, and it may be possible to employ a rotary brush type configuration for removing cutting waste by a rotating brush or a blade type configuration for removing cutting waste by a blade.

What is claimed is:

1. A paper processing apparatus comprising:

a supporting member for supporting a paper;

a pressing member which forms a space between said pressing member and said supporting member, and approaches and presses a paper bundle inserted into the space;

a cutting blade which cuts an end portion of the paper bundle pressed by said pressing member;

a removal member having a front end portion which removes cutting waste of the paper bundle;

a driving unit which drives said pressing member; and a control unit which controls at least said driving unit, wherein said control unit controls said driving unit such that pressing by said pressing member is released after the end portion of the paper bundle pressed by said pressing member is cut by said cutting blade, and said control unit controls, when determining that the front end portion of said removal member does not reach said pressing member at a position of said pressing member in a state in which the pressing by said pressing member has been released, said driving unit to move said pressing member to a position at which the front end portion of said removal member reaches said pressing member after the paper bundle is taken out.

2. The paper processing apparatus as claimed in claim 1, wherein said control unit determines whether the front end portion of said removal member reaches said pressing member at the position of said pressing member in the state in which the pressing by said pressing member has been released, based on a thickness of the paper bundle.

3. The paper processing apparatus as claimed in claim 1, wherein said control unit determines whether the front end portion of said removal member reaches said pressing member at the position of said pressing member in the state in which the pressing by said pressing member has been released, based on a number of papers constituting the paper bundle.

4. The paper processing apparatus as claimed in claim 1, wherein said removal member is composed of a paddle which is rotated.

5. The paper processing apparatus as claimed in claim 1, wherein said control unit controls said removal member such that the cutting waste of the paper bundle is repeatedly removed.

6. The paper processing apparatus as claimed in claim 1, wherein said control unit controls said driving unit such that said pressing member waits at the position, at which the front end portion of said removal member reaches said pressing member, when the paper bundle is inserted into the space.

7. The paper processing apparatus as claimed in claim 1, wherein said control unit controls said removal member to start an operation of removing the cutting waste of the paper bundle before the paper bundle is inserted into the space.

8. The paper processing apparatus as claimed in claim 1, wherein said paper bundle is saddle-stitched, and the end portion of the paper bundle, which is cut by said cutting blade, is an edge of the paper bundle.

9. An image forming system comprising:

an image forming apparatus which forms an image on a paper; and a paper post-processing apparatus which performs post-processing on a paper bundle which is formed by stacking a plurality of papers on which an image is formed by said image forming apparatus, wherein said paper post-processing apparatus is composed of said paper processing apparatus as claimed in claim 1.

10. A paper processing apparatus comprising:

a supporting member for supporting a paper;

a pressing member which forms a space between said pressing member and said supporting member, and approaches and presses a paper bundle inserted into the space;

a cutting blade which cuts an end portion of the paper bundle pressed by said pressing member;

a removal member having a front end portion which removes cutting waste of the paper bundle;

a driving unit which drives said pressing member;

a pressing release control part which controls said driving unit such that pressing by said pressing member is released after the end portion of the paper bundle pressed by said pressing member is cut by said cutting blade;

a reach determination control part which determines whether the front end portion of said removal member reaches said pressing member at a position of said pressing member when the pressing by said pressing member has been released by said pressing release control part; and a movement control part which controls, when said reach determination control part determines that the front end portion of said removal member does not reach said pressing member, said driving unit to move said pressing member to a position, at which the front end portion of said removal member reaches said pressing member, after the paper bundle is taken out.

* * * * *